US009690242B2

(12) United States Patent
Samei et al.

(10) Patent No.: US 9,690,242 B2
(45) Date of Patent: Jun. 27, 2017

(54) FIXING DEVICE AND IMAGE FORMING APPARATUS INCORPORATING SAME

(71) Applicants: Masahiro Samei, Osaka (JP); Tomohiko Fujii, Osaka (JP); Yoshihiro Fukuhata, Hyogo (JP); Tamotsu Ikeda, Kanagawa (JP); Minoru Toyoda, Hyogo (JP); Yoshiharu Takahashi, Osaka (JP); Daisuke Inoue, Tokyo (JP)

(72) Inventors: Masahiro Samei, Osaka (JP); Tomohiko Fujii, Osaka (JP); Yoshihiro Fukuhata, Hyogo (JP); Tamotsu Ikeda, Kanagawa (JP); Minoru Toyoda, Hyogo (JP); Yoshiharu Takahashi, Osaka (JP); Daisuke Inoue, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/192,521

(22) Filed: Jun. 24, 2016

(65) Prior Publication Data

US 2017/0003634 A1 Jan. 5, 2017

(30) Foreign Application Priority Data

Jul. 2, 2015 (JP) ..... 2015-133459

(51) Int. Cl.
*G03G 15/20* (2006.01)

(52) U.S. Cl.
CPC ..... *G03G 15/2064* (2013.01); *G03G 15/2053* (2013.01); *G03G 15/206* (2013.01);
(Continued)

(58) Field of Classification Search
CPC ..... G03G 15/2064; G03G 15/2053; G03G 2215/2058; G03G 2215/2061; G03G 2215/2064
(Continued)

(56) References Cited

U.S. PATENT DOCUMENTS 6,226,487 B1 * 5/2001 Yamashita ..... G03G 15/167 399/307
7,050,748 B2 * 5/2006 Akita ..... G03G 15/2053 219/216
(Continued)

FOREIGN PATENT DOCUMENTS

| | | |
|---|---|---|
| JP | 2002-040860 | 2/2002 |
| JP | 2009-037078 | 2/2009 |
| JP | 2016-038545 | 3/2016 |

OTHER PUBLICATIONS

U.S. Appl. No. 14/953,947, filed Nov. 30, 2015.

*Primary Examiner* — Hoang Ngo
(74) *Attorney, Agent, or Firm* — Oblon, McClelland, Maier & Neustadt, L.L.P.

(57) ABSTRACT

A fixing device includes a first rotary body, a second rotary body to contact the first rotary body, and a plain bearing that supports the first rotary body or the second rotary body. One rotary body of the first rotary body and the second rotary body has an outer diameter increasing, while the other rotary body has an outer diameter decreasing, in a curved line from an axial center portion to axial end portions of the first rotary body and the second rotary body at least between the first rotary body and the second rotary body. A recording medium passes between the first rotary body and the second rotary body with a circumferential component of a shear force generated between the first rotary body and the second rotary body by use of the plain bearing being in a range of from 15N to 25N.

10 Claims, 12 Drawing Sheets

(52) U.S. Cl.
CPC ..... *G03G 2215/2061* (2013.01); *G03G 2215/2064* (2013.01)

(58) Field of Classification Search
USPC ..... 399/328, 329, 330
See application file for complete search history.

(56) References Cited

U.S. PATENT DOCUMENTS

| | | | |
|---|---|---|---|
| 2007/0223976 | A1 | 9/2007 | Yagi et al. |
| 2008/0013992 | A1 | 1/2008 | Fukuhata et al. |
| 2008/0013993 | A1 | 1/2008 | Obata et al. |
| 2008/0031664 | A1 | 2/2008 | Yagi et al. |
| 2008/0063442 | A1 | 3/2008 | Yagi et al. |
| 2008/0069611 | A1 | 3/2008 | Obata et al. |
| 2009/0110449 | A1 | 4/2009 | Saito et al. |
| 2009/0129836 | A1 | 5/2009 | Sakaya et al. |
| 2010/0034548 | A1 | 2/2010 | Naitoh et al. |
| 2010/0178089 | A1 | 7/2010 | Fukuhata |
| 2010/0239297 | A1 | 9/2010 | Sakaya et al. |
| 2010/0260524 | A1 | 10/2010 | Hiraoka et al. |
| 2010/0272481 | A1 | 10/2010 | Yamamoto et al. |
| 2011/0052285 | A1 | 3/2011 | Fukuhata |
| 2011/0188874 | A1 | 8/2011 | Takahashi et al. |
| 2011/0299899 | A1 | 12/2011 | Ishigaya et al. |
| 2011/0311283 | A1 | 12/2011 | Fukuhata |
| 2012/0002997 | A1 | 1/2012 | Hiraoka et al. |
| 2012/0020681 | A1 | 1/2012 | Naitoh et al. |
| 2012/0020690 | A1 | 1/2012 | Yamamoto et al. |
| 2012/0045241 | A1 | 2/2012 | Takahashi et al. |
| 2012/0093532 | A1 | 4/2012 | Ishigaya et al. |
| 2012/0093534 | A1 | 4/2012 | Waida et al. |
| 2012/0148287 | A1 | 6/2012 | Samei et al. |
| 2012/0148317 | A1 | 6/2012 | Samei et al. |
| 2012/0177422 | A1 | 7/2012 | Nanno et al. |
| 2012/0195652 | A1 | 8/2012 | Takahashi et al. |
| 2012/0243895 | A1 | 9/2012 | Samei et al. |
| 2012/0275834 | A1 | 11/2012 | Naitoh et al. |
| 2013/0004192 | A1 | 1/2013 | Kawakami et al. |
| 2013/0004213 | A1 | 1/2013 | Takahashi |
| 2013/0004214 | A1 | 1/2013 | Sakaya et al. |
| 2013/0004216 | A1 | 1/2013 | Ikeda |
| 2013/0004217 | A1 | 1/2013 | Ikeda et al. |
| 2013/0004222 | A1 | 1/2013 | Sakaya et al. |
| 2013/0051876 | A1 | 2/2013 | Ishigaya et al. |
| 2013/0064586 | A1 | 3/2013 | Adachi et al. |
| 2013/0308990 | A1 | 11/2013 | Samei et al. |
| 2014/0056625 | A1 | 2/2014 | Naitoh et al. |
| 2014/0072354 | A1 | 3/2014 | Toyoda et al. |
| 2014/0072357 | A1 | 3/2014 | Fukuhata et al. |
| 2014/0093288 | A1 | 4/2014 | Naitoh et al. |
| 2014/0099138 | A1 | 4/2014 | Ishigaya et al. |
| 2014/0099146 | A1 | 4/2014 | Fujii et al. |
| 2014/0112691 | A1 | 4/2014 | Nanno et al. |
| 2014/0133877 | A1 | 5/2014 | Samei et al. |
| 2014/0153982 | A1 | 6/2014 | Adachi et al. |
| 2014/0153983 | A1 | 6/2014 | Fujii et al. |
| 2014/0219672 | A1 | 8/2014 | Samei et al. |
| 2014/0219673 | A1 | 8/2014 | Yamamoto et al. |
| 2014/0219696 | A1 | 8/2014 | Fujimoto et al. |
| 2014/0227001 | A1 | 8/2014 | Kishi et al. |
| 2014/0314459 | A1 | 10/2014 | Samei |
| 2015/0071688 | A1 | 3/2015 | Yamaguchi et al. |
| 2015/0078768 | A1 | 3/2015 | Yamaguchi et al. |
| 2015/0139705 | A1 | 5/2015 | Furuichi et al. |
| 2015/0198920 | A1 | 7/2015 | Fukuhata et al. |
| 2015/0220028 | A1 | 8/2015 | Samei et al. |
| 2015/0220029 | A1 | 8/2015 | Samei et al. |
| 2015/0248091 | A1 | 9/2015 | Nanno et al. |
| 2015/0346662 | A1 | 12/2015 | Kawarasaki et al. |
| 2016/0033911 | A1 | 2/2016 | Fukuhata et al. |
| 2016/0041511 | A1 | 2/2016 | Fujii et al. |
| 2016/0098000 | A1 | 4/2016 | Furuichi et al. |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2015-133459, filed on Jul. 2, 2015, in the Japan Patent Office, the entire disclosure of which is hereby incorporated by reference herein.

BACKGROUND

Technical Field

Embodiments of this disclosure generally relate to a fixing device for fixing a toner image on a recording medium and an image forming apparatus incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotary body such as a roller, a belt, or a film, and an opposed rotary body such as a roller or a belt pressed against the fixing rotary body. The toner image is fixed onto the recording medium under heat and pressure while the recording medium is conveyed between the fixing member and the opposed member.

SUMMARY

In one embodiment of this disclosure, an improved fixing device is described that includes a first rotary body, a second rotary body and a plain bearing. The second rotary body contacts the first rotary body to form an area of contact between the first rotary body and the second rotary body, through which a recording medium bearing a toner image passes. The plain bearing supports the first rotary body or the second rotary body. One rotary body of the first rotary body and the second rotary body has an outer diameter increasing in a curved line from an axial center portion to axial end portions of the one rotary body at least at the area of contact between the first rotary body and the second rotary body. The other rotary body of the first rotary body and the second rotary body has an outer diameter decreasing in a curved line from an axial center portion to axial end portions of the other rotary body at least at the area of contact between the first rotary body and the second rotary body. The recording medium passes between the first rotary body and the second rotary body with a circumferential component of a shear force generated between the first rotary body and the second rotary body by use of the plain bearing being in a range of from 15N to 25N.

Also described is an image forming apparatus incorporating the fixing device as described above.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
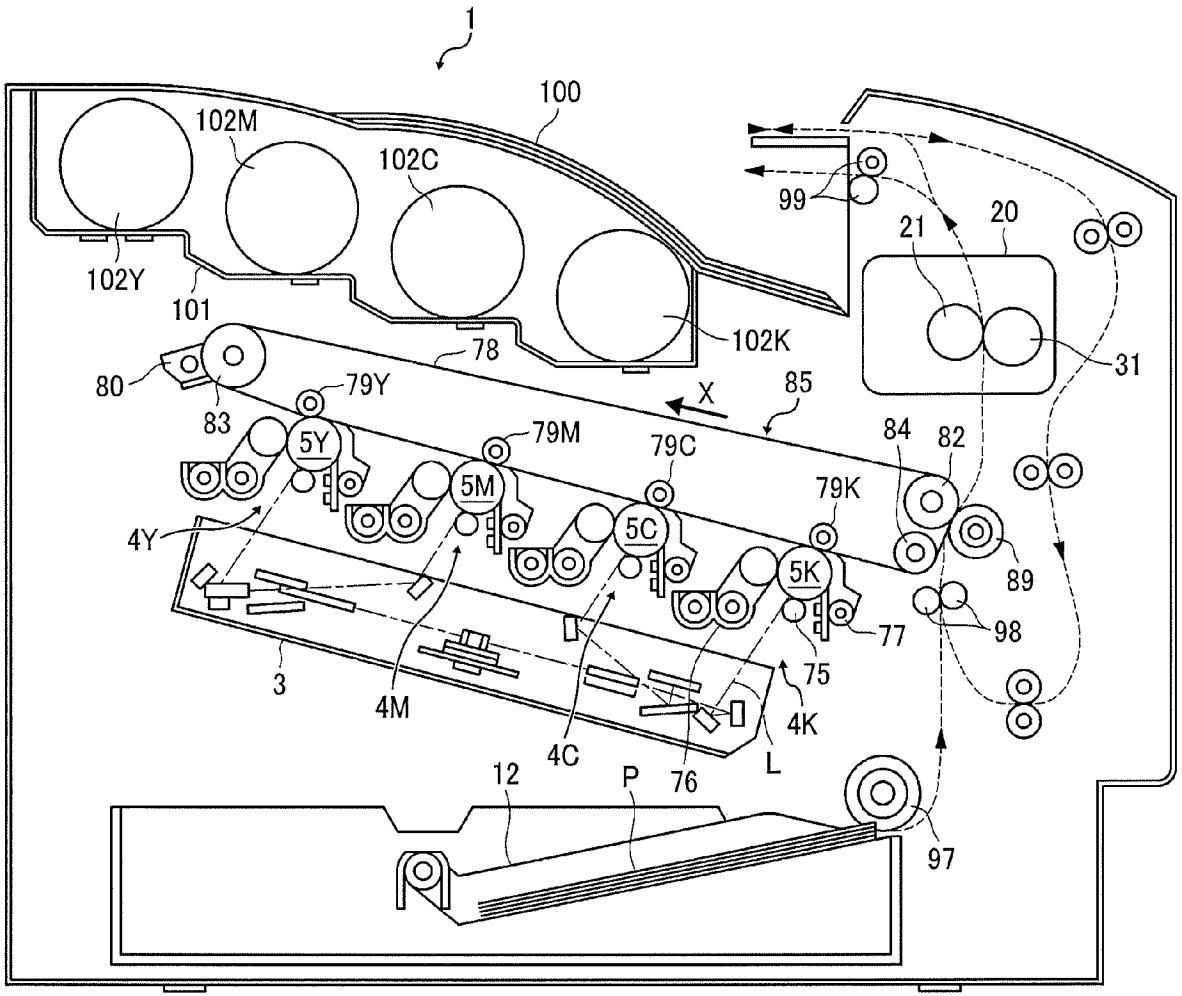
FIG. 1 is a schematic view of an image forming apparatus according to an embodiment of this disclosure.

The accompanying drawings are intended to depict embodiments of this disclosure and should not be interpreted to limit the scope thereof

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable to this disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of this disclosure are described below.

Initially with reference to FIG. 1, a description is given of a configuration and an operation of an image forming apparatus 1 according to an embodiment of this disclosure.

FIG. 1 is a schematic view of the image forming apparatus 1.

As illustrated in FIG. 1, the image forming apparatus 1 is a tandem color printer. A bottle container 101 is disposed in an upper portion of a main body of the image forming apparatus 1. The bottle container 101 includes four toner bottles 102Y, 102M, 102C and 102K, which are removable from the bottle container 101, and therefore replaceable. The toner bottles 102Y, 102M, 102C and 102K contain toner of yellow, magenta, cyan and black, respectively. It is to be noted that, in the following description, suffixes Y, M, C and K denote colors yellow, magenta, cyan and black, respectively. To simplify the description, these suffixes are omitted unless necessary.

An intermediate transfer unit 85 is disposed below the bottle container 101. The intermediate transfer unit 85 includes an intermediate transfer belt 78. Four image forming devices 4Y, 4M, 4C and 4K are arranged side by side, facing the intermediate transfer belt 78 to form toner images of yellow, magenta, cyan and black, respectively. The image forming devices 4Y, 4M, 4C and 4K include drum-shaped photoconductors 5Y, 5M, 5C and 5K, respectively.

Each of the photoconductors 5Y, 5M, 5C and 5K is surrounded by various pieces of imaging equipment, such as a charging device 75, a developing device 76, a cleaning device 77 and a charge neutralizing device.

It is to be noted that, in FIG. 1, reference numerals 75 through 77 are assigned to the charging device, the developing device and the cleaning device, respectively, of the image forming device 4K that forms a black toner image only. Since the image forming devices 4Y, 4M, 4C and 4K have identical configurations differing only in the color of toner, reference numerals for the image forming devices 4Y, 4M and 4C that form yellow, magenta and cyan toner images, respectively, are omitted.

A series of imaging processes, namely, charging, exposure, developing, primary transfer and cleaning processes are performed on each of the photoconductors 5Y, 5M, 5C and 5K. Accordingly, the toner images of yellow, magenta, cyan and black are formed on the photoconductors 5Y, 5M, 5C and 5K, respectively. The photoconductors 5Y, 5M, 5C and 5K are rotated in a clockwise direction in FIG. 1 by a driving motor.

In the charging process, the surfaces of the photoconductors 5Y, 5M, 5C and 5K are uniformly charged at a position opposite the respective charging devices 75.

In the exposure process, the photoconductors 5Y, 5M, 5C and 5K are rotated further and reach a position opposite an exposure device 3, where the surfaces of the photoconductors 5Y, 5M, 5C and 5K are scanned with and exposed by light beams L emitted from the exposure device 3 to form the electrostatic latent images of yellow, magenta, cyan and black on the surfaces of the photoconductors 5Y, 5M, 5C and 5K, respectively.

In the developing process, the photoconductors 5Y, 5M, 5C and 5K are rotated further and reach a position opposite the respective developing devices 76, where the electrostatic latent images are developed with toner of yellow, magenta, cyan and black into visible images, also known as toner images of yellow, magenta, cyan and black, respectively.

In the primary transfer process, the photoconductors 5Y, 5M, 5C and 5K are rotated further and reach a position opposite primary-transfer bias rollers 79Y, 79M, 79C and 79K, respectively, via the intermediate transfer belt 78, where the toner images are transferred from the photoconductors 5Y, 5M, 5C and 5K onto the intermediate transfer belt 78.

At this time, a small amount of toner may remain untransferred on the surfaces of the photoconductors 5Y, 5M, 5C and 5K as residual toner.

In the cleaning process, the photoconductors 5Y, 5M, 5C and 5K are rotated further and reach a position opposite the respective cleaning devices 77, where the residual toner on the surfaces of the photoconductors 5Y, 5M, 5C and 5K are mechanically collected by respective cleaning blades of the cleaning devices 77.

Finally, the photoconductors 5Y, 5M, 5C and 5K are rotated and reach a position opposite the respective neutralizing devices, where residual potential is removed from the respective surfaces of the photoconductors 5Y, 5M, 5C and 5K. Thus, a series of image forming processes performed on the surfaces of the photoconductors 5Y, 5M, 5C and 5K is completed.

The toner images formed on the surfaces of the photoconductors 5Y, 5M, 5C and 5K through the developing process are transferred onto the intermediate transfer belt 78 while being superimposed one atop another to form a color toner image on the intermediate transfer belt 78.

In addition to the intermediate transfer belt 78 and the four primary-transfer bias rollers 79Y, 79M, 79C and 79K, the intermediate transfer unit 85 includes, e.g., a secondary-transfer backup roller 82, a cleaning backup roller 83, a tension roller 84 and an intermediate transfer cleaner 80.

The intermediate transfer belt 78 is entrained around and supported by the three rollers 82 through 84, namely, the secondary-transfer backup roller 82, the cleaning backup roller 83 and the tension roller 84. Thus, the intermediate transfer belt 78 is formed into an endless loop. The intermediate transfer belt 78 is rotated in a counterclockwise direction in FIG. 1 by rotation of the secondary-transfer backup roller 82. The primary-transfer bias rollers 79Y, 79M, 79C and 79K and the photoconductors 5Y, 5M, 5C and 5K sandwich the intermediate transfer belt 78 to form four areas of contact herein called primary transfer nips, respectively.

Each of the primary-transfer bias rollers 79Y, 79M, 79C and 79K is applied with a transfer bias having a polarity opposite a polarity of toner. The intermediate transfer belt 78 travels in a direction indicated by arrow X in FIG. 1, and successively passes through the primary transfer nips formed between the primary-transfer bias rollers 79Y, 79M, 79C and 79K, on the one hand, and the photoconductors 5Y, 5M, 5C and 5K, respectively, on the other hand. Thus, the toner images formed on the respective surfaces of the photoconductors 5Y, 5M, 5C and 5K are primarily transferred onto the intermediate transfer belt 78 while being superimposed one atop another to form a color toner image thereon.

Then, the intermediate transfer belt 78 bearing the color toner image reaches a position opposite a secondary-transfer roller 89, where the secondary-transfer backup roller 82 and the secondary transfer roller 89 sandwich the intermediate transfer belt 78 to form an area of contact herein called a secondary transfer nip. At the secondary transfer nip, the color toner image is transferred from the intermediate transfer belt 78 onto a recording medium P conveyed.

At this time, a small amount of toner may remain untransferred on the intermediate transfer belt 78 as residual toner. Then, the intermediate transfer belt 78 reaches a position opposite the intermediate transfer cleaner 80, where the residual toner is collected from the intermediate transfer belt 78.

Thus, a series of transfer processes performed on the intermediate transfer belt 78 is completed.

Now a detailed description is given of movement of the recording medium P.

The recording medium P is fed from a sheet feeder 12 disposed in a lower portion of the main body of the image forming apparatus 1, and conveyed to the secondary transfer nip via a sheet-feeding roller 97 and a timing roller pair 98.

Specifically, the sheet feeder 12 accommodates a plurality of recording media P, such as transfer sheets, resting one atop another. When the sheet-feeding roller 97 is rotated in the counterclockwise direction in FIG. 1, an uppermost recording medium P of the plurality of recording media P is fed toward an area of contact, herein called a roller nip, between rollers of the timing roller pair 98. The recording medium P conveyed to the timing roller pair 98 temporarily stops at the roller nip, as the timing roller pair 98 stops rotating.

The timing roller pair 98 is rotated again to convey the recording medium P to the secondary transfer nip in synchronization with the movement of the intermediate transfer belt 78 bearing the color toner image to transfer the color toner image onto the recording medium P at the secondary transfer nip.

Thereafter, the recording medium P bearing the color toner image is conveyed to a fixing device 20 that includes, e.g., a fixing roller 21 serving as a fixing rotary body and a pressure roller 31 serving as a pressure rotary body. In the fixing device 20, the color toner image is fixed onto the recording medium P under heat and pressure applied by the fixing roller 21 and the pressure roller 31.

Then, the recording medium P bearing the fixed color toner image passes through a sheet-ejection roller pair 99, which ejects the recording medium P onto an output tray 100 located outside the main body of the image forming apparatus 1. Thus, the plurality of recording media P bearing output images rest one atop another on the output tray 100. Accordingly, a series of image forming processes performed in the image forming apparatus 1 is completed.

Figure 2:
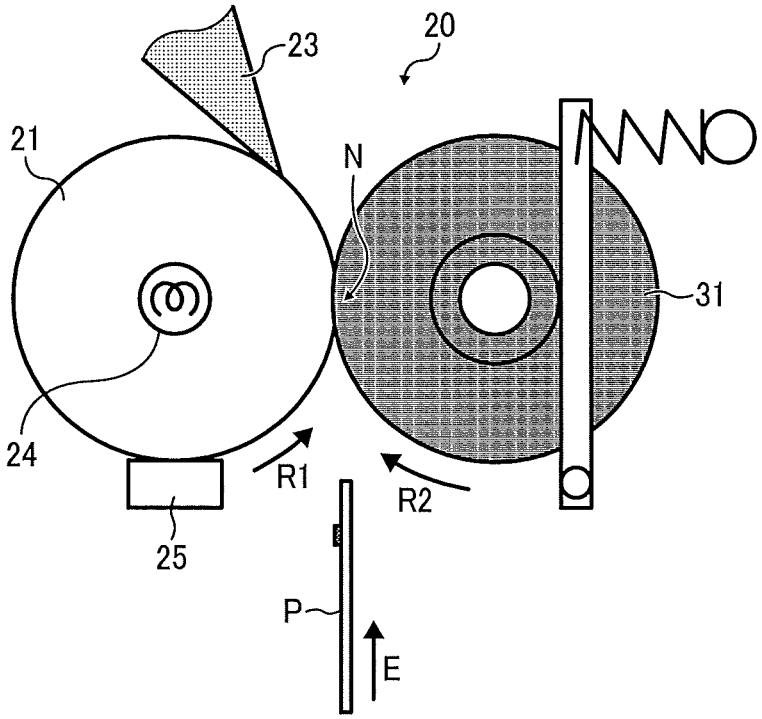
FIG. 2 is a schematic view of a fixing device incorporated in the image forming apparatus of FIG. 1.
Figure 3:
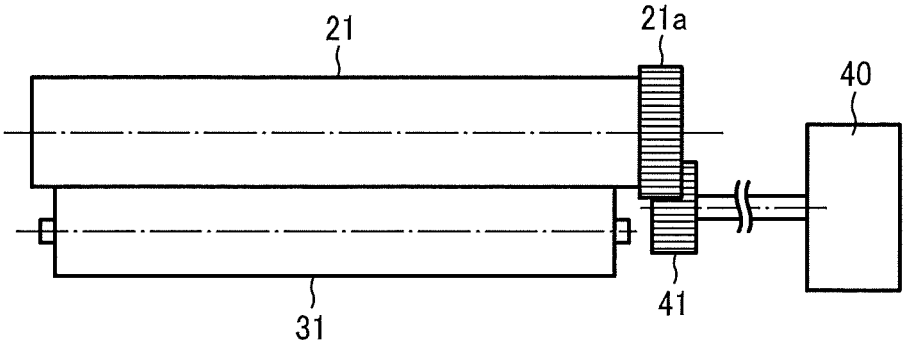
FIG. 3 is a schematic view of a driving system of the fixing device of FIG. 2.

Referring now to FIGS. 2 and 3, a description is given of a basic configuration of the fixing device 20 incorporated in the image forming apparatus 1 described above.

FIG. 2 is a schematic view of the fixing device 20. FIG. 3 is a schematic view of a driving system of the fixing device 20.

As illustrated in FIG. 2 and described above, the fixing device 20 includes two rotary bodies, namely, the fixing roller 21 and the pressure roller 31. The fixing roller 21 and the pressure roller 31 contact each other and forms an area of contact, herein called a nip N. Inside the fixing roller 21 is a halogen heater 24 serving as a heater to heat the fixing roller 21. The fixing roller 21 and the pressure roller 31 are configured to be driven by a driver 40 illustrated in FIG. 3, such as a motor, to rotate in directions indicated by arrows R1 and R2, respectively, in FIG. 2.

As illustrated in FIG. 3, in the present embodiment, the fixing roller 21 has one end portion provided with a gear 21*a* continuous in a circumferential direction of the fixing roller 21, whereas the driver 40 is provided with a drive gear 41. The fixing roller 21 is coupled to the driver 40 via the gear 21 a engaged with the drive gear 41. When the driver 40 starts running, a driving force is transmitted from the driver 40 to the fixing roller 21 through the gear 21*a* to rotate the fixing roller 21. In the meantime, the rotation of the fixing roller 21 rotates the pressure roller 31, which is rotatably supported by a bearing. In other words, the fixing roller 21 serves as a driving roller, whereas the pressure roller 31 serves as a driven roller.

Referring back to FIG. 2, the fixing roller 21 is a cylinder with a heat-conductive base body coated by a releasing layer. The heat-conductive base body particularly includes a high heat-conductive material with a certain mechanical strength such as carbon steel or aluminum. The releasing layer coating the base body includes a material that reliably releases toner while having a high thermal conductivity and a high durability. For example, the releasing layer is a tube made of fluororesin or perfluoro alkoxy (PFA), or a rubber layer such as a silicone-rubber layer or a fluoro-rubber layer. Alternatively, a coating material made of fluororesin such as PFA or polytetrafluoroethylene (PTFE) may be used as the releasing layer.

The pressure roller 31 is a cylinder constituted of a cored bar, an elastic layer formed on an outer circumference of the cored bar and a coating layer coating the elastic layer. The cored bar is, e.g., a carbon steel tube for machine structural purposes (STKM, JIS standard). The elastic layer is silicone rubber or fluororubber. Alternatively, the elastic layer may be a silicone-rubber foam or a fluoro-rubber foam. The coating layer is a tube made of heat-resistant fluororesin such as PFA or PTFE with a high releasability. The pressure roller 31 is pressed against the fixing roller 21 by a biasing mechanism such as a spring.

As illustrated on an upper side of FIG. 2, a claw-shaped separator 23 having a sharp tip is disposed facing the fixing roller 21, on a downstream side from the nip N in a recording medium conveyance direction E in which a recording medium P is conveyed. In the present embodiment, four separators 23 are disposed axially along the fixing roller 21. It is to be noted that the number of separators 23 is not limited to four provided that a plurality of separators 23 are disposed.

The separators 23 particularly include a material with a high releasability and a high slidability such as PFA, polyetherketone (PEK), or polyether ether ketone (PEEK), particularly. The separators 23 may have an outer circumferential surface coated by a material with a high releasability and a high slidability such as PFA or Teflon® (registered trademark).

Each of the separators 23 is provided with a biasing member that presses the corresponding separator 23 against the fixing roller 21. The biasing member is, e.g., a coil spring. Alternatively, another biasing member may be used in consideration of various conditions such as installation space and production costs.

Around the fixing roller 21 are disposed a thermistor 25 serving as a temperature detector and a thermostat for preventing abnormal temperature, for example. The thermistor 25 outputs a detection signal so that the surface temperature of the fixing roller 21 is controlled within a predetermined temperature range.

Now, a description is given of cleaning of the fixing device 20.

In a fixing device, generally, a toner image or toner melts under heat from at least one of the rotary bodies of the fixing device, and is fixed on a recording medium. However, due to shortage or excess of heat, or due to electrostatic effects, a small amount of toner might fail to be fixed on the recording medium but is instead transferred to at least one of the rotary bodies, adhering thereto as residual toner. Such residual toner produces a localized decrease in the releasability of toner from a part of the rotary body bearing the residual toner, i.e., the fixability of toner on the recording medium. As a result, in the next fixing process, a toner image might fail to be fixed on a recording medium at the part of the rotary body bearing the residual toner and adheres to the rotary body. As the rotary body rotates, such a toner image on the rotary body is then transferred to the recording medium as an offset image at a pitch defined by the periphery of the rotary body.

Figure 4A:
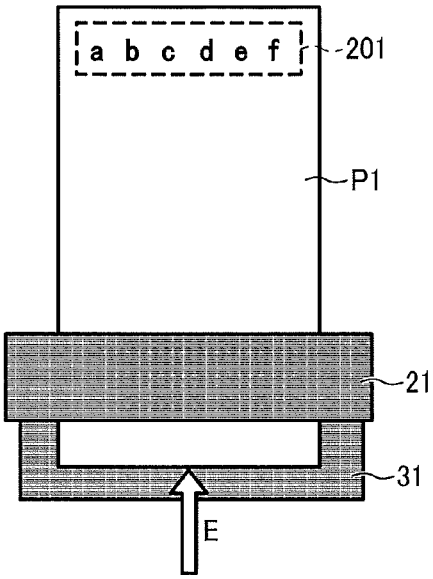
FIG. 4A is a schematic view of a recording medium passing between a fixing roller and a pressure roller incorporated in the fixing device of FIG. 2.
Figure 4B:
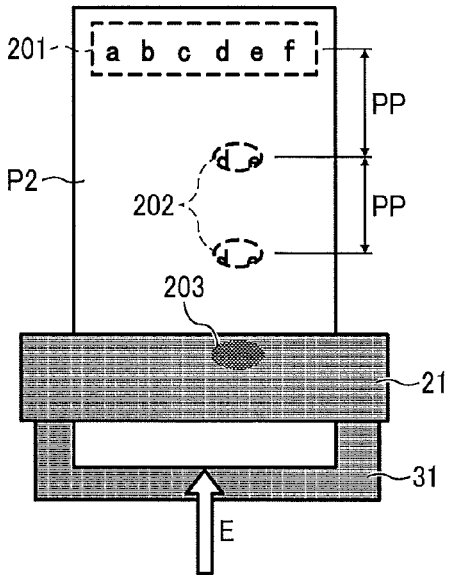
FIG. 4B is a schematic view of a recording medium passing between the fixing roller and the pressure roller, bearing an offset image due to toner adhering to the fixing roller.

FIG. 4A is a schematic view of a recording medium P1 passing between the fixing roller 21 and the pressure roller 31. FIG. 4B is a schematic view of a recording medium P2 passing between the fixing roller 21 and the pressure roller 31, bearing an offset image due to toner adhering to the fixing roller 21.

As illustrated in FIG. 4A, when an unfixed image pattern 201 passes through the nip N between the pressure roller 31 and the fixing roller 21 bearing no toner as a cause for contamination, an offset image does not appear as a reliable fixability is ensured. However, if toner 203 adheres to the fixing roller 21 as illustrated in FIG. 4B, the toner 203 degrades the fixability of a part of the fixing roller 21 to which the toner 203 adheres. Therefore, unfixed toner passing on the toner 203 is not reliably fixed to the recording medium P2, causing a fixing error, more specifically, creating an offset image 202 on the recording medium P2 at a pitch PP defined by the periphery of the fixing roller 21 as illustrated in FIG. 4B.

In recent years, recording media often contain a large amount of filler such as calcium carbonate. When using such recording media, the filler often adheres to the rotary bodies, and causes so-called filming in which toner or toner components adhere to the rotary body. Therefore, particularly when using such recording media, the releasability of toner from the rotary body tends to decrease markedly.

One approach to such a problem involves providing a fixing device (referred to as a comparative fixing device below) including a fixing rotary body and a pressure rotary body that differ in traveling velocity between the surfaces thereof before a recording medium reaches a fixing nip between the fixing rotary body and the pressure rotary body. With such a difference in traveling velocity, the residual toner is transferred from the surface of the pressure rotary body to the fixing rotary body, and thus removed. However, a removal force for removing such toner obtained by the difference in traveling velocity between the fixing rotary body and the pressure rotary body is insufficient to remove toner containing a large amount of paper dust, such as toner filler. Additionally, in the fixing device, since the toner is removed from the pressure rotary body before the recording medium reaches the fixing nip, the removal of toner is reduced during conveyance of the recording medium through the fixing nip.

In the present embodiment, the fixing device 20 prevents such a fixing error attributed to toner adhering to the rotary bodies.

Figure 5:
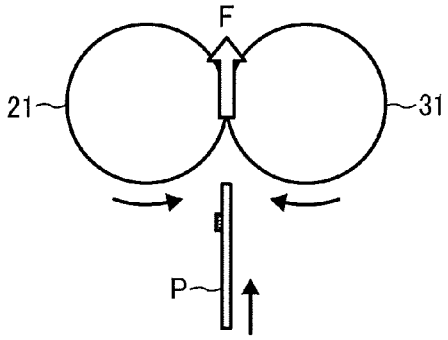
FIG. 5 is a schematic view of the fixing roller and the pressure roller with a shear force generated therebetween.

FIG. 5 is a schematic view of the fixing roller 21 and the pressure roller 31 with a shear force F generated between the fixing roller 21 and the pressure roller 31.

As described above, the rotation of the fixing roller 21 rotates the pressure roller 31. In the meantime, the pressure roller 31 is rotationally subjected to a frictional force generated between a rotational shaft and the bearing of the pressure roller 31. Consequently, the shear force F is generated between the rotating fixing roller 21 and the rotated pressure roller 31 as indicated by arrow F in FIG. 5.

In the present embodiment, the intensity of a circumferential component of the shear force F in a rotational direction of the fixing roller 21 or the pressure roller 31 is in a range of from 15N to 25N. To keep the intensity of the circumferential component of the shear force F within the above-described range, a plain bearing is used as the bearing that supports the pressure roller 31 because a plain bearing imposes a rotational load greater than that of an antifriction bearing, also known as a rolling contact bearing.

Figure 6A:
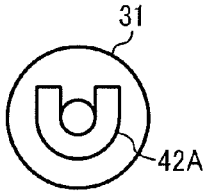
FIG. 6A is a schematic view of an example of a plain bearing that supports the pressure roller.
Figure 6B:
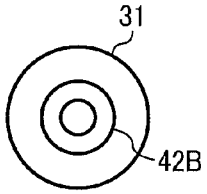
FIG. 6B is a schematic view of another example of the plain bearing.

FIG. 6A is a schematic view of a U-shaped plain bearing 42A as an example of a plain bearing that supports the pressure roller 31. FIG. 6B is a schematic view of a cylindrical plain bearing 42B as another example of the plain bearing.

Either the plain bearing 42A or the plain bearing 42B may be used to support the pressure roller 31. The plain bearing includes a material of e.g., tetrafluoroethylene (TFE), polyimide (PI), polyamideimide (PAI) or polyphenylene sulfide (PPS).

With such a shear force F, having an intensity of the circumferential component of from 15N to 25N, generated between the fixing roller 21 and the pressure roller 31, a recording medium P scrapes toner off from the surface of the fixing roller 21 or the pressure roller 31 while passing through the nip N.

Figure 7A:
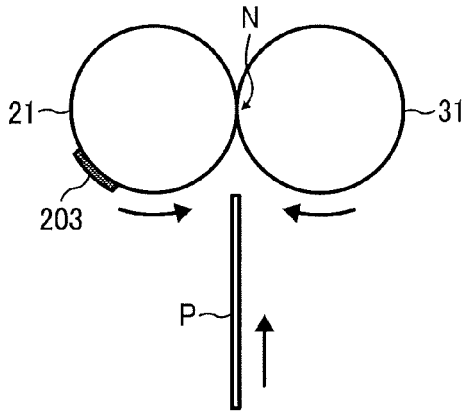
FIG. 7A is a schematic view of the pressure roller and the fixing roller bearing toner before a recording medium passes between the pressure roller and the fixing roller.
Figure 7B:
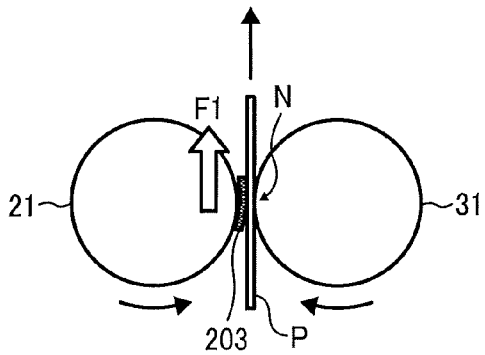
FIG. 7B is a schematic view of the pressure roller and the fixing roller with toner and the recording medium located between the pressure roller and the fixing roller.
Figure 7C:
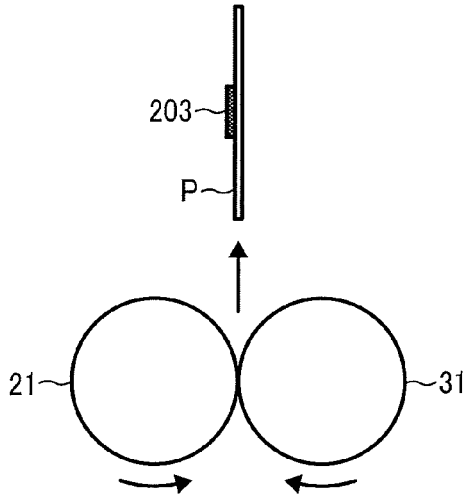
FIG. 7C is a schematic view of the pressure roller and the fixing roller after the recording medium passes between the pressure roller and the fixing roller.

Referring now to FIGS. 7A through 7C, a description is given of an example in which the recording medium P scrapes toner off from the surface of the fixing roller 21.

FIG. 7A is a schematic view of the pressure roller 31 and the fixing roller 21 bearing toner before the recording medium P passes through the nip N. FIG. 7B is a schematic view of the pressure roller 31 and the fixing roller 21 with the toner 203 and the recording medium P located at the nip. FIG. 7C is a schematic view of the pressure roller 31 and the fixing roller 21 after the recording medium P passes through the nip N.

When the toner 203 adheres to the surface of the fixing roller 21 as illustrated in FIG. 7A, the recording medium P scrapes the toner 203 off from the fixing roller 21 while passing through the nip N with a shear force F1 generated between the surface of the fixing roller 21 and the recording medium P as illustrated in FIG. 7B. Thus, the toner 203 is scraped off from the fixing roller 21 and transferred onto the recording medium P as illustrated in FIG. 7C. Then, the recording medium P bearing the toner 203 is ejected from the image forming apparatus 1. It is to be noted that little toner is transferred onto the recording medium P and thus does not degrade image quality.

Figure 8A:
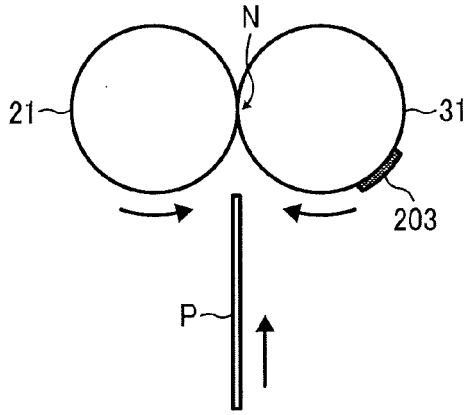
FIG. 8A is a schematic view of the fixing roller and the pressure roller bearing toner before a recording medium passes between the fixing roller and the pressure roller.
Figure 8B:
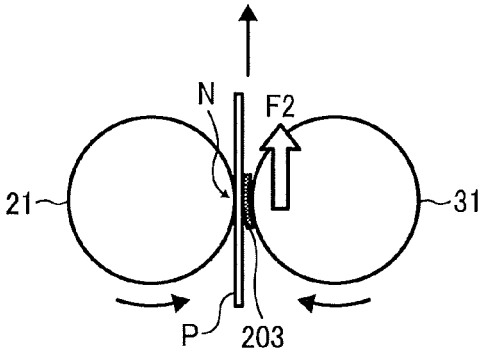
FIG. 8B is a schematic view of the fixing roller and the pressure roller with toner and the recording medium located between the fixing roller and the pressure roller.
Figure 8C:
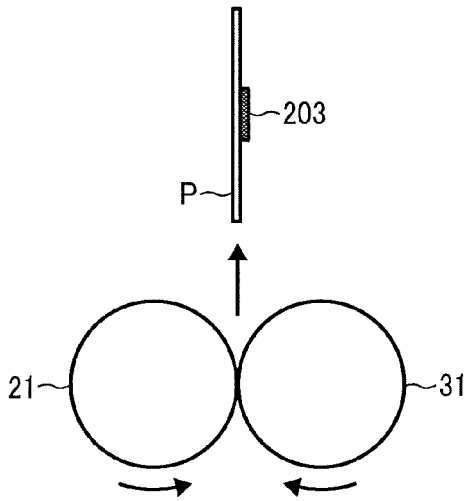
FIG. 8C is a schematic view of the fixing roller and the pressure roller after the recording medium passes between the fixing roller and the pressure roller.

Referring now to FIGS. 8A through 8C, a description is given of an example in which the recording medium P scrapes toner off from the surface of the pressure roller 31.

FIG. 8A is a schematic view of the fixing roller 21 and the pressure roller 31 bearing toner before the recording medium P passes through the nip N. FIG. 8B is a schematic view of the fixing roller 21 and the pressure roller 31 with the toner 203 and the recording medium P located at the nip. FIG. 8C is a schematic view of the fixing roller 21 and the pressure roller 31 after the recording medium P passes through the nip N.

When the toner 203 adheres to the surface of the pressure roller 31 as illustrated in FIG. 8A, the recording medium P scrapes the toner 203 from the pressure roller 31 while passing through the nip N with a shear force F2 generated between the surface of the pressure roller 31 and the recording medium P as illustrated in FIG. 8B. Thus, the toner 203 is scraped off from the pressure roller 31 and transferred onto the recording medium P as illustrated in FIG. 8C. Then, the recording medium P bearing the toner 203 is ejected from the image forming apparatus 1.

In the present embodiment, as described above, the pressure roller 31 is rotated by the rotation of the fixing roller 21. Accordingly, the shear force F1 generated between the surface of the fixing roller 21 and the recording medium P is equal to the shear force F2 generated between the surface of the pressure roller 31 and the recording medium P.

Figure 9:
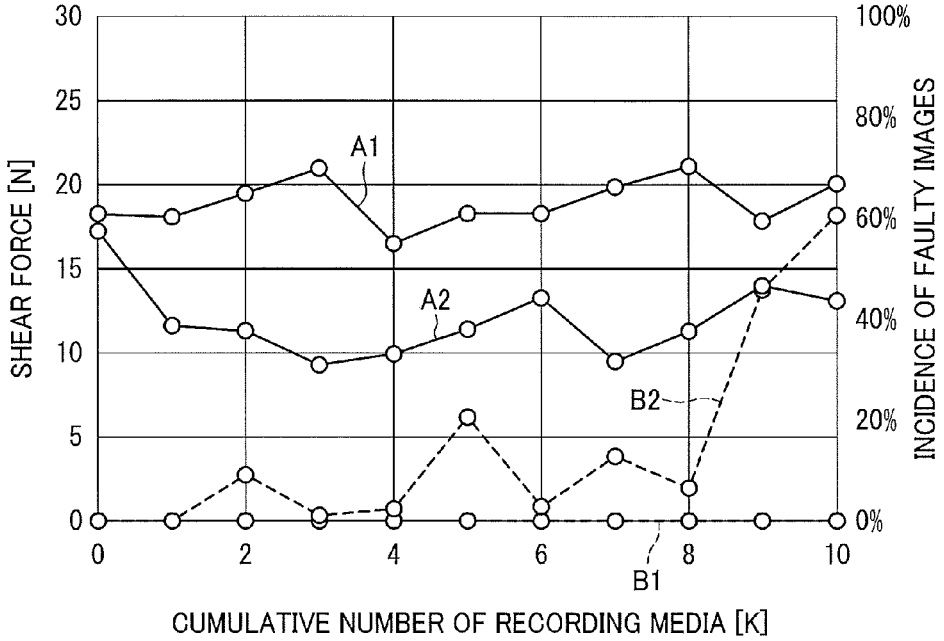
FIG. 9 is a graph illustrating a relationship between the intensity of a circumferential component of a shear force and the incidence of faulty images attributed to toner adhering to the fixing roller and the pressure roller.

Referring now to FIG. 9, a description is given of a reason for keeping the intensity of the circumferential component of the shear force F of from 15N to 25N in the present embodiment.

FIG. 9 is a graph illustrating a relationship between the intensity of a circumferential component of a shear force and the incidence of faulty images attributed to toner adhering to the fixing roller and the pressure roller.

In FIG. 9, solid lines A1 and A2 indicate the intensities of the circumferential component of the shear force generated between the fixing roller and the pressure roller. Broken lines B1 and B2 indicate the incidence of faulty images attributed to toner adhering to the fixing roller. The shear force A1 corresponds to the incidence of faulty images B1.

The shear force A2 corresponds to the incidence of faulty images B2. The horizontal axis indicates the cumulative number, by the thousands, of recording media passing through a nip between the fixing roller and the pressure roller.

In the results of examination illustrated in FIG. 9, when the circumferential component of the shear force was in a range from 15N to 25N as indicated by the solid line A1, the incidence of faulty images stayed at 0% as indicated by the broken line B1. On the other hand, when the circumferential component of the shear force was less than 15N as indicated by the solid line A2, the incidence of faulty images increased as the number of recording media passing through the nip increased, as indicated by the broken line B2. That is, the shear force A2 was too small to sufficiently remove toner from a fixing roller. Therefore, as the number of recording media passing through the nip increased, the toner was accumulated on the fixing roller and created faulty images such as offset images. On the other hand, the shear force A1 having a circumferential component equal to or larger than 15N was sufficient to remove the toner from the fixing roller and minimized accumulation of toner on the fixing roller. As a result, no faulty image appeared.

Accordingly, in the present embodiment, the circumferential component of the shear force is equal to or larger than 15N to sufficiently remove toner from the fixing roller 21 and relatively minimize the accumulation of toner on the fixing roller 21. By contrast, when the circumferential component of the shear force is less than 15N, the toner might be insufficiently removed from the fixing roller 21. Additionally, when the circumferential component of the shear force is larger than 25N, the recording media might be wrinkled. Hence, in the present embodiment, the circumferential component of the shear force is equal to or less than 25N to prevent the recording media from being wrinkled so as to obtain reliable images.

In FIG. 9, at the beginning stage where the number of recording media passing through the nip was small, specifically less than approximately 500, the circumferential component of the shear force A2 was equal to or larger than 15N and approximately the same as the shear force A1. However, as the number of recording media passing through the nip increased, the shear force A2 dropped down. In order to generate different shear forces A1 and A2, plain bearings having different materials were used to support the pressure roller. Since new plain bearings were used, at the beginning stage, the difference in material of the plain bearings did not affect the shear force or the characteristics of rotational load. Specifically, since the plain bearings were covered by skin layers at the beginning stage, the difference in material of the plain bearings was not exhibited. However, as the skin layers were impaired and the characteristics of material itself were exhibited, different shear forces were generated. Accordingly, in a fixing device using a new plain bearing or its equivalent, it might be hard to determine whether the circumferential component of the shear force is equal to or larger than 15N at the beginning stage of conveying recording media. Therefore, the determination may be made after the number of recording media passing through the nip reaches a thousand.

In the present embodiment, the shear force F between the fixing roller 21 and the pressure roller 31 stays in the above-described predetermined range. Additionally, in order to enhance the removal of toner from the rollers, the fixing roller 21 has different outer diameters axially along the fixing roller 21.

Figure 10:
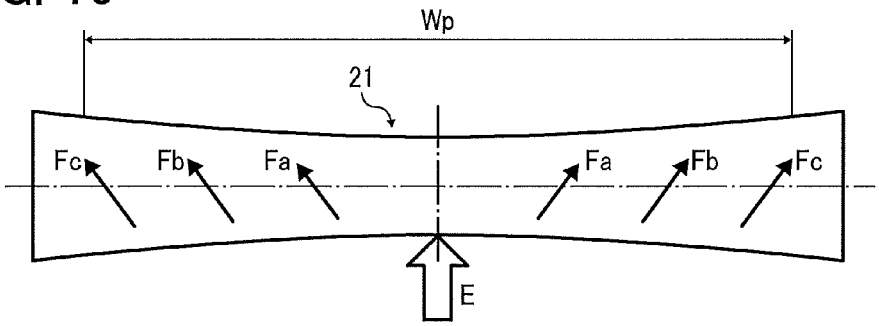
FIG. 10 is a schematic view of an outer circumferential shape of the fixing roller according to a first embodiment of this disclosure.
Figure 11:
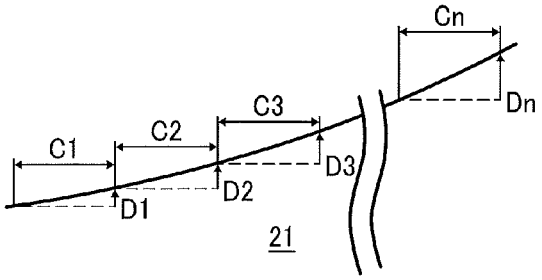
FIG. 11 is a partially enlarged view of an outer circumference of the fixing roller of FIG. 10.

FIG. 10 is a schematic view of an outer circumferential shape of the fixing roller 21 according to a first embodiment of this disclosure. FIG. 11 is a partially enlarged view of an outer circumference of the fixing roller 21.

As illustrated in FIG. 10, the outer diameter of the fixing roller 21 increases in a curved line from an axial center portion to axial end portions of the fixing roller 21. Additionally, a rate of increase in the outer diameter of the fixing roller 21 increases from the axial center portion to the axial end portions of the fixing roller 21. It is to be noted that the rate of increase in the outer diameter is an amount of increase in the outer diameter per predetermined axial length of the fixing roller 21. Specifically, as illustrated in FIG. 11, the fixing roller 21 has areas C1 through Cn having a predetermined length axially along the fixing roller 21. D1 through Dn indicate the amount of increase of the outer diameter relative to an adjacent area closer to the axial center portion of the fixing roller 21. In the areas C1 through Cn, the amount of increase D1 through Dn gradually increases from the axial center portion to the axial end portions of the fixing roller 21 as follows: D1<D2<D3< . . . <Dn. Thus, the rate of increase in the outer diameter increases toward the axial end portions of the fixing roller 21.

It is to be noted that the actual rate of increase in the outer diameter of the fixing roller 21 is not as high as that illustrated in FIGS. 10 and 11. However, for the purpose of clarifying the change in the outer diameter of the fixing roller 21, the outer circumferential shape thereof is exaggerated in the accompanying drawings.

Figure 12:
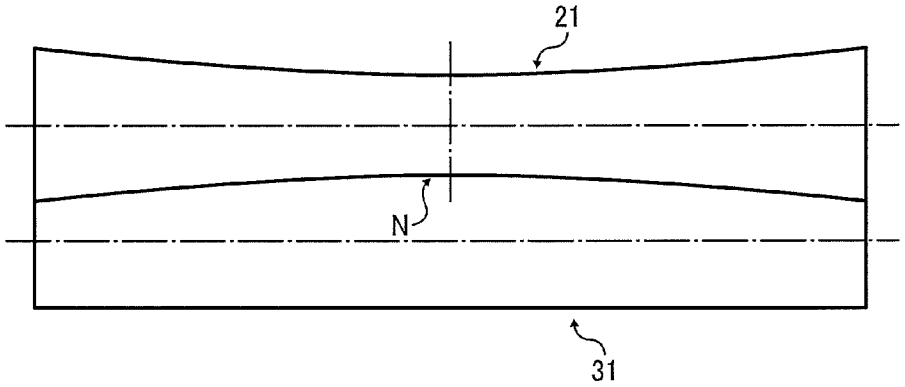
FIG. 12 is a schematic view of the fixing roller in contact with the pressure roller pressed against the fixing roller.

FIG. 12 is a schematic view of the fixing roller 21 in contact with the pressure roller 31 pressed against the fixing roller 21.

The pressure roller 31 has a constant outer diameter axially along the pressure roller 31. Since the pressure roller 31 is an elastic roller, softer than a hard roller, having an elastic layer, the shape of the pressure roller 31 elastically changes by contacting the fixing roller 21, which is a hard roller. Therefore, the outer circumferential surface of the pressure roller 31 is deformed, conforming to the shape of the fixing roller 21 at least at the nip N. Contrary to the fixing roller 21, the outer diameter of the pressure roller 31 decreases in a curved line from an axial center portion to axial end portions of the pressure roller 31.

As described above, when the fixing roller 21 and the pressure roller 31 are rotated while the pressure roller 31 is pressed against the fixing roller 21, shear forces Fa through Fc are generated between the fixing roller 21 and the pressure roller 31 as indicated by arrows Fa through Fc in FIG. 10. The shear forces Fa through Fc are generated, inclining toward the axial end portions of the fixing roller 21 and the pressure roller 31 with respect to the recording medium conveyance direction E, which is perpendicular to a line connecting an axis of rotation of the fixing roller 21 and an axis of rotation of the pressure roller 31. The shear forces Fa through Fc gradually increase toward the axial end portions of the fixing roller 21 and the pressure roller 31 as follows: Fa<Fb<Fc. It is to be noted that, in FIG. 10, six shear forces (a pair of shear forces Fa, a pair of shear forces Fb and a pair of shear forces Fc) are illustrated for descriptive purposes as the shear forces generated axially between the fixing roller 21 and the pressure roller 31. Actually, however, shear forces different in intensity are generated axially between the fixing roller 21 and the pressure roller 31.

In the present embodiment, as described above, the shear forces Fa through Fc incline toward the axial end portions of the fixing roller 21 and the pressure roller 31 with respect to the recording medium conveyance direction E. This is because the outer diameter of the fixing roller 21 increases toward the axial end portions of the fixing roller 21, causing different circumferential velocities between the axial center portion and the axial end portions of the fixing roller 21. Additionally, the shear forces Fa through Fc gradually increase toward the axial end portions of the fixing roller 21 and the pressure roller 31. This is because the rate of increase in the outer diameter of the fixing roller 21 increases from the axial center portion to the axial end portions of the fixing roller 21.

Figure 23:
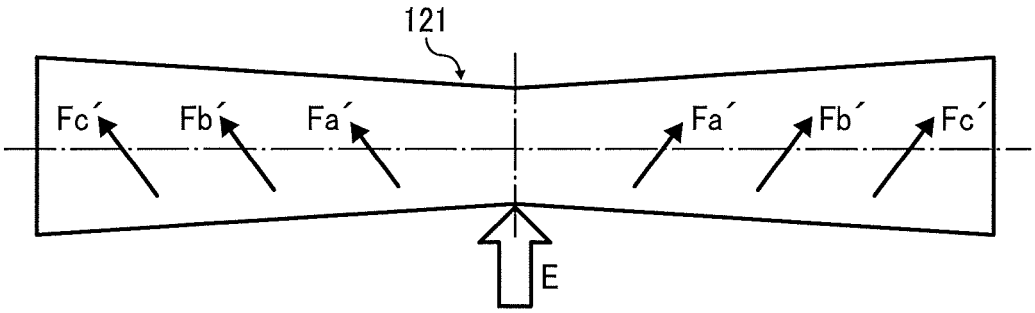
FIG. 23 is a schematic view of an outer circumferential shape of a fixing roller according to a comparative example.

Referring now to FIG. 23, a description is given of a fixing roller 121 according to a comparative example.

FIG. 23 is a schematic view of an outer circumferential shape of the fixing roller 121.

In this comparative example, the fixing roller 121 has an outer diameter that increases at a fixed rate. In other words, as illustrated in FIG. 23, the outer diameter of the fixing roller 121 increases in a straight line. Shear forces Fa' through Fc' are generated having identical intensities axially along the fixing roller 121.

With such shear forces Fa' through Fc' generated between the fixing roller 121 and a pressure roller disposed opposite the fixing roller 121, recording media might scrape off toner from the fixing roller 121 or the pressure roller while passing through a nip between the fixing roller and the pressure roller. However, since the shear forces Fa' through Fc' have identical intensities and show no differences between them, the toner might be insufficiently removed from the fixing roller or the pressure roller.

By contrast, in the present embodiment, the shear forces Fa through Fc are generated having different intensities. Such differences among the shear forces Fa through Fc contribute to effective removal of toner. Accordingly, in the fixing device 20 according to the present embodiment, the removal of toner adhering to the fixing roller 21 or the pressure roller 31 is enhanced compared to the comparative example of FIG. 23. Additionally, in the present embodiment, since the shear force increases toward the axial end portions of the fixing roller 21 and the pressure roller 31, the toner is effectively removed particularly from the axial end portions of the fixing roller 21 or the pressure roller 31.

It is to be noted that, in the present embodiment, the outer diameter of the fixing roller 21 changes in a continuous curved line, axially along the fixing roller 21. Alternatively, the outer diameter of the fixing roller 21 may change in a curved line partially, axially along the fixing roller 21. In order to effectively remove the toner by the recording medium P so as to prevent appearance of offset images, the outer diameter of the fixing roller 21 preferably changes at least in a range of a width Wp (refer to FIG. 10), which is a width of a recording medium P passing through the nip N.

The circumferential component of the shear force generated between the fixing roller 21 and the pressure roller 31 is obtained by the following equation:

$$Fr=Tr/R \quad (1),$$

where R represents a radius of the fixing roller 21, Tr represents a torque or a rotational force generated on the fixing roller 21, and Fr represents a circumferential component of the shear force.

Thus, the circumferential component of the shear force Fr equals the torque Tr divided by the radius R of the fixing roller 21. In the present embodiment, the fixing roller 21 have different radii R axially along the fixing roller 21. Therefore, for the sake of simplicity, an average radius of the fixing roller 21 is used as the radius R of the fixing roller 21 for calculation of the circumferential component of the shear force Fr.

Figure 13:
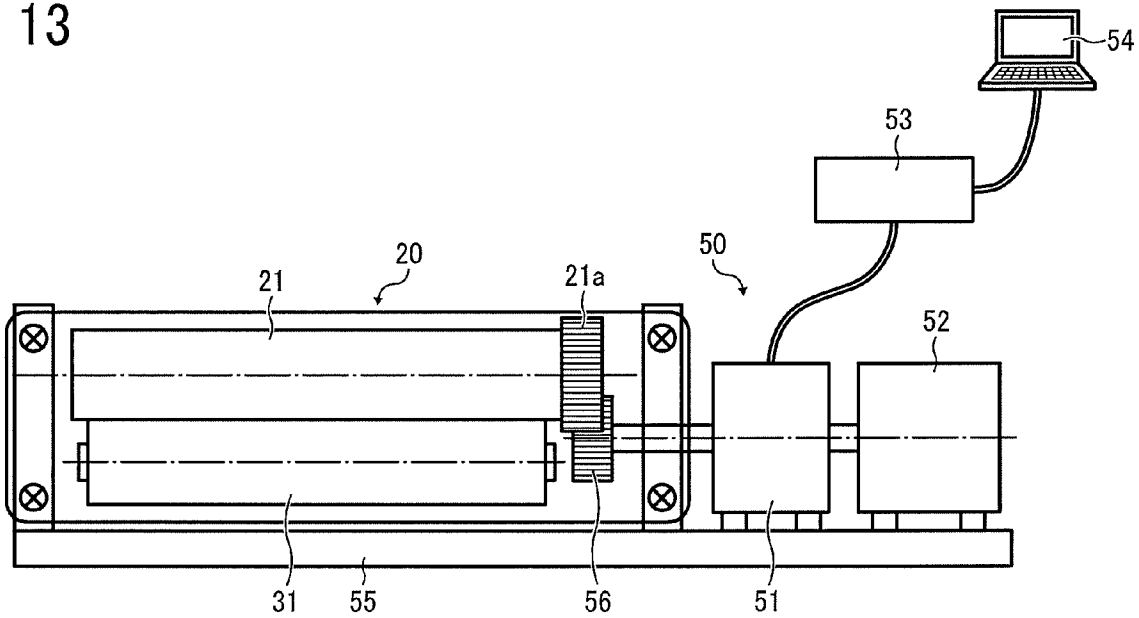
FIG. 13 is a schematic view of the fixing roller and a torque meter coupled to the fixing roller.

On the other hand, the torque Tr is a total torque generated on the fixing roller 21. The total torque is measured by, e.g., a torque meter 50 illustrated in FIG. 13. FIG. 13 is a schematic view of the fixing roller 21 and the torque meter 50 coupled to the fixing roller 21.

As illustrated in FIG. 13, the torque meter 50 includes a torque converter 51, a motor 52, a signal conditioner 53, a computer 54 and a base 55. The torque converter 51 and the motor 52 are disposed on the base 55. The computer 54 is connected to the torque converter 51 via the signal conditioner 53. The motor 52 includes a rotational shaft passing through the torque converter 51. A drive gear 56 is mounted on an end portion of the rotational shaft of the motor 52.

In order to measure the total torque generated on the fixing roller 21, firstly, the fixing device 20 including the fixing roller 21 is secured onto the base 55, so as to couple the gear 21*a* mounted on the axial end portion of the fixing roller 21 to the drive gear 56. When the motor 52 is activated, torques are generated on the fixing roller 21. The torque converter 51 measures the total torque generated on the fixing roller 21. The signal conditioner 53 converts measurement data to a predetermined signal and input it to the computer 54 that calculates the total torque.

Figure 14:
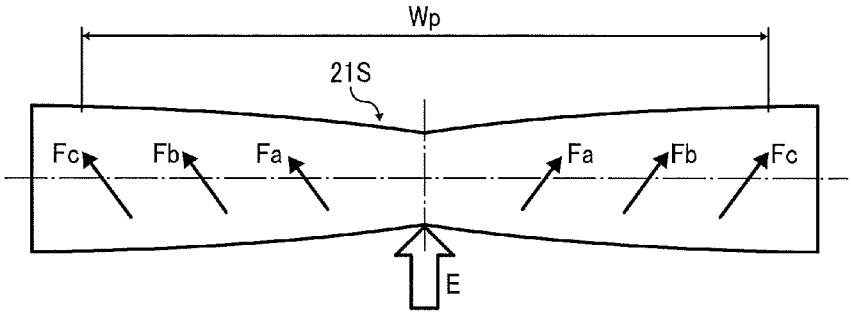
FIG. 14 is a schematic view of an outer circumferential shape of a fixing roller according to a second embodiment.
Figure 15:
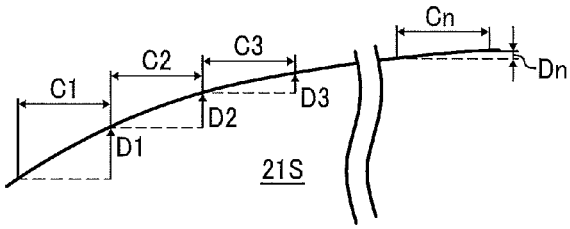
FIG. 15 is a partially enlarged view of an outer circumference of the fixing roller of FIG. 14.
Figure 16:
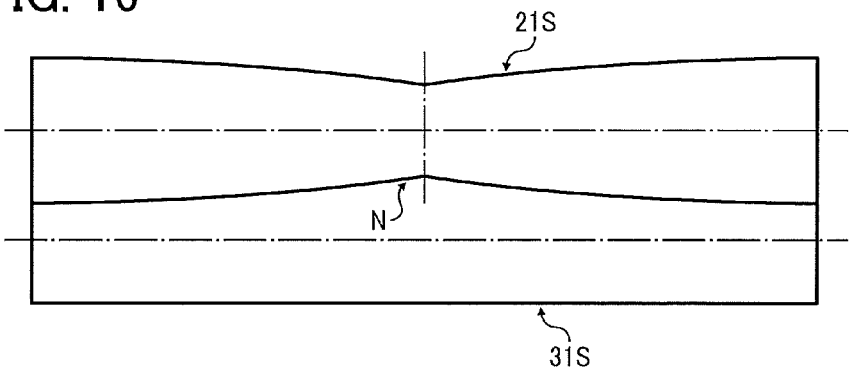
FIG. 16 is a schematic view of the fixing roller in contact with a pressure roller pressed against the fixing roller.

By inputting the total torque Tr of the fixing roller 21 thus obtained and the average radius R of the fixing roller 21 into the above-described equation, the circumferential component of the shear force Fr generated between the fixing roller 21 and the pressure roller 31 is obtained. Accordingly, e.g., the intensity of the torque and the radius of the fixing roller 21 are adjusted such that the circumferential component of the shear force Fr is in a range of from 15N to 25N. In the present embodiment, the total torque of the fixing roller 21 as a drive roller is calculated. However, if a pressure roller is a drive roller, the circumferential component of the shear force Fr of the circumferential component of the shear force may be calculated using a total torque of the pressure roller calculated similarly and an average radius of the pressure roller at the nip between the fixing roller and the pressure roller. Referring now to FIGS. 14 through 16, a description is given of a second embodiment of this disclosure.

FIG. 14 is a schematic view of an outer circumferential shape of a fixing roller 21S according to the second embodiment. FIG. 15 is a partially enlarged view of an outer circumference of the fixing roller 21S.

Since the basic configuration of the fixing device 20 according to the second embodiment is substantially identical to the configuration of the fixing device 20 according to the first embodiment, a detailed description thereof is herein omitted.

Like the first embodiment, the outer diameter of the fixing roller 21S increases in a curved line from an axial center portion to axial end portions of the fixing roller 21S, at different rates of increase. However, in the present embodiment, the rate of increase in the outer diameter of the fixing roller 21S decreases from the axial center portion to the axial end portions of the fixing roller 21S. Specifically, as illustrated in FIG. 15, the fixing roller 21S has areas C1 through Cn having a predetermined length axially along the fixing roller 21S. D1 through Dn indicate the amount of increase of the outer diameter of an area relative to an adjacent area closer to the axial center portion of the fixing roller 21S. In the areas C1 through Cn, the amount of increase D1 through Dn gradually decreases from the axial center portion to the axial end portions of the fixing roller 21S as follows: D1>D2>D3> . . . >Dn. Thus, the rate of increase in the outer diameter decreases toward the axial end portions of the fixing roller 21S.

FIG. 16 is a schematic view of the fixing roller 21S in contact with a pressure roller 31S pressed against the fixing roller 21S.

Like the first embodiment, the pressure roller 31S is an elastic roller. Therefore, when the pressure roller 31S is pressed against the fixing roller 21S, the pressure roller 31 is deformed, conforming to the shape of the fixing roller 21S at least at a nip N between the fixing roller 21S and the pressure roller 31S.

When the fixing roller 21S and the pressure roller 31S are rotated while the pressure roller 31S is pressed against the fixing roller 21S, shear forces Fa through Fc are generated between the fixing roller 21S and the pressure roller 31S as indicated by arrows Fa through Fc in FIG. 14. The shear forces Fa through Fc are generated, inclining toward the axial end portions of the fixing roller 21S and the pressure roller 31S with respect to a recording medium conveyance direction E, which is perpendicular to a line connecting an axis of rotation of the fixing roller 21S and an axis of rotation of the pressure roller 31S. However, in the present embodiment, the shear force Fa through Fc gradually decrease toward the axial end portions of the fixing roller 21S and the pressure roller 31S as follows: Fa>Fb>Fc, because the rate of increase in the outer diameter of the fixing roller 21S decreases from the axial center portion to the axial end portions of the fixing roller 21S.

Like the first embodiment, the shear force F changes axially along the fixing roller 21S as illustrated in FIG. 14. Accordingly, the different shear forces Fa through Fc contribute to effective removal of toner from the fixing roller 21S. Additionally, in the present embodiment, since the shear force F increases toward the axial center portion of the fixing roller 21S and the pressure roller 31S, the toner is effectively removed particularly from the axial center portion of the fixing roller 21S and the pressure roller 31S.

Figure 17:
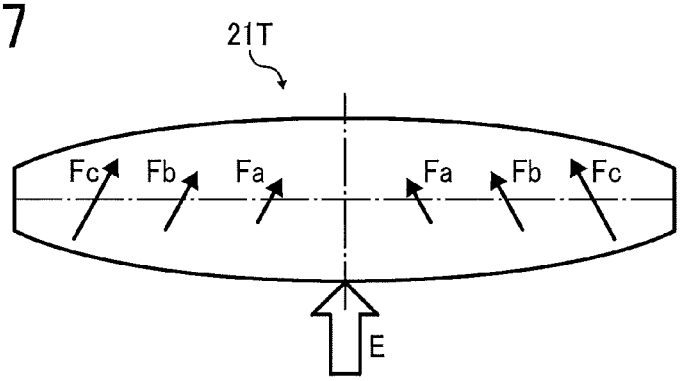
FIG. 17 is a schematic view of an outer circumferential shape of a fixing roller according to a third embodiment.
Figure 18:
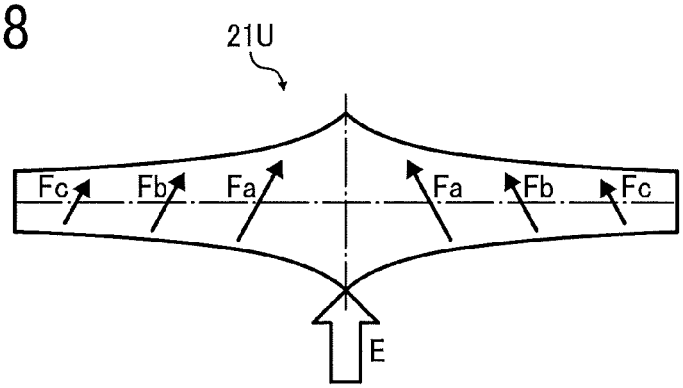
FIG. 18 is a schematic view of an outer circumferential shape of a fixing roller according to a fourth embodiment.

Referring now to FIGS. 17 and 18, a description is given of third and fourth embodiments of this disclosure.

FIG. 17 is a schematic view of an outer circumferential shape of a fixing roller 21T according to the third embodiment. FIG. 18 is a schematic view of an outer circumferential shape of a fixing roller 21U according to the fourth embodiment.

In the third embodiment, the outer diameter of the fixing roller 21T decreases from an axial center portion to axial end portions of the fixing roller 21T. A rate of decrease in the outer diameter increases from the axial center portion to the axial end portions of the fixing roller 21T. In the fourth embodiment, the outer diameter of the fixing roller 21U also decreases from an axial center portion to axial end portions of the fixing roller 21U. However, contrary to the third embodiment, the rate of decrease in the outer diameter decreases from the axial center portion to the axial end portions of the fixing roller 21U.

In the third embodiment, shear forces Fa through Fc generated between the fixing roller 21T and a pressure roller, disposed opposite the fixing roller 21T, gradually increase toward the axial end portions of the fixing roller 21T and the pressure roller as follows: Fa<Fb<Fc. By contrast, in the fourth embodiment, shear forces Fa through Fc generated between the fixing roller 21U and a pressure roller, disposed opposite the fixing roller 21U, gradually decrease toward the axial end portions of the fixing roller 21U and the pressure roller as follows: Fa>Fb>Fc. Thus, the shear force F changes axially along the fixing roller 21T. Similarly, the shear force F changes axially along the fixing roller 21U. However, the shear forces Fa through Fc increase toward the axial end portions of the fixing roller 21T whereas the shear forces Fa through Fc decrease toward the axial end portions of the fixing roller 21U. Accordingly, the different shear forces Fa through Fc contribute to effective removal of toner from the fixing roller 21T and the fixing roller 21U.

In the third embodiment, the shear forces Fa through Fc are generated, inclining toward the axial center portion of the fixing roller 21T with respect to a recording medium conveyance direction E, which is perpendicular to a line connecting an axis of rotation of the fixing roller 21T and an axis of rotation of the pressure roller opposite the fixing roller 21T. Similarly, in the fourth embodiment, the shear forces Fa through Fc are generated, inclining toward the axial center portion of the fixing roller 21U with respect to a recording medium conveyance direction E, which is perpendicular to a line connecting an axis of rotation of the fixing roller 21U and an axis of rotation of the pressure roller opposite the fixing roller 21U. Therefore, the fixing roller 21 or the fixing roller 21S may prevent the recording medium P from being wrinkled more effectively, compared to the fixing roller 21T and the fixing roller 21U. Particularly, the fixing roller 21 effectively prevents the recording medium P from being wrinkled because the shear forces Fa through Fc increase toward the axial end portions of the fixing roller 21.

Figure 19:
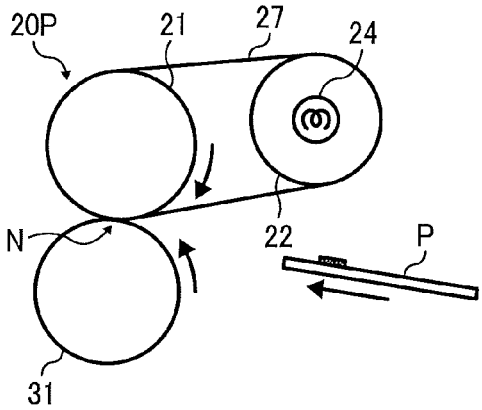
FIG. 19 is a schematic view of a fixing device as a variation of the fixing device of FIG. 2.

Referring now to FIG. 19, a description is given of a fixing device 20P as a variation of the fixing device 20 described above.

FIG. 19 is a schematic view of the fixing device 20P.

The fixing device 20P includes a fixing roller 21, a heating roller 22, a halogen heater 24 disposed inside the heating roller 22, an endless fixing belt 27 entrained around the fixing roller 21 and the heating roller 22, and a pressure roller 31 that contacts the fixing roller 21 via the fixing belt 27. In the fixing device 20P, toner is effectively removed from at least one of the fixing belt 27 and the pressure roller 31 with shear forces generated between the fixing belt 27 and the pressure roller 31 by incorporating any one of the fixing rollers according to the first through fourth embodiments as the fixing roller 21. Specifically, due to the configuration of the fixing roller 21, one of the fixing belt 27 and the pressure roller 31 in contact with each other has an outer diameter increasing while the other has an outer diameter decreasing in a curved line from an axial center portion to axial end portions of the fixing belt 27 and the pressure roller 31 at least at a nip N between the fixing belt 27 and the pressure roller 31. Such a configuration generates shear forces, between the fixing belt 27 and the pressure roller 31, the intensity of which changes axially along the fixing roller 21 and the pressure roller 31. Such different shear forces contribute to the effective removal of toner.

Figure 20:
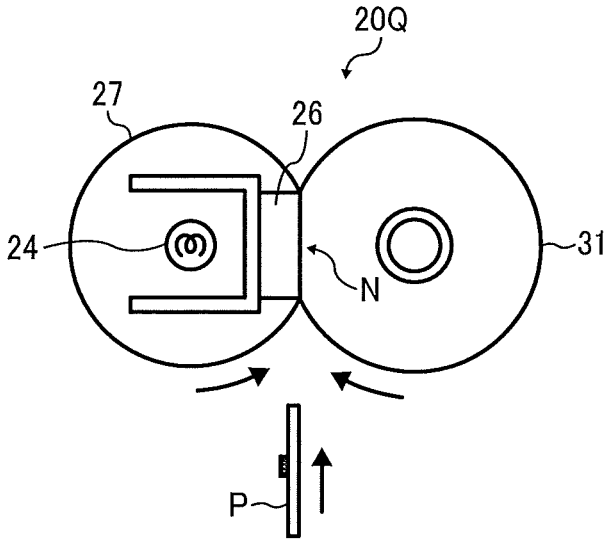
FIG. 20 is a schematic view of a fixing device as another variation of the fixing device of FIG. 2.
Figure 21A:
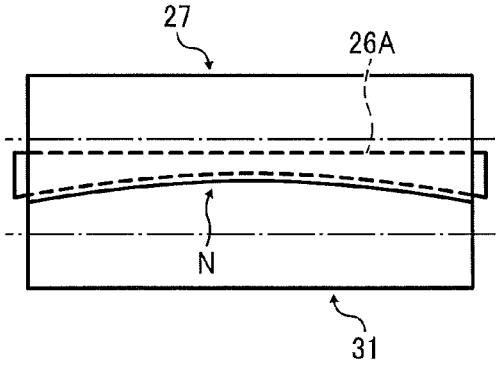
FIG. 21A is a schematic view of a first variation of a nip formation pad and surrounding components incorporated in the fixing device of FIG. 20.
Figure 21B:
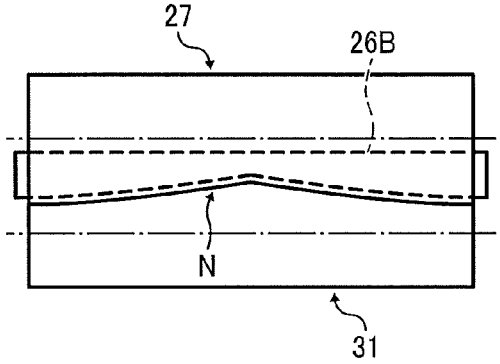
FIG. 21B is a schematic view of a second variation of the nip formation pad and surrounding components incorporated in the fixing device of FIG. 20.
Figure 21C:
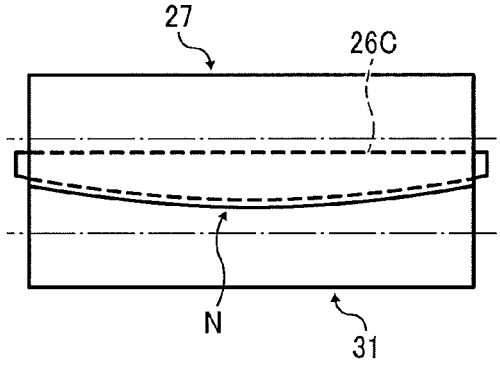
FIG. 21C is a schematic view of a third variation of the nip formation pad and surrounding components incorporated in the fixing device of FIG. 20.
Figure 21D:
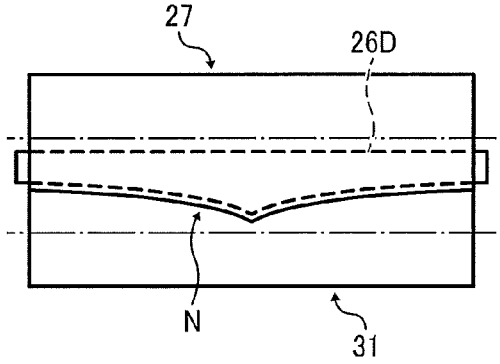
FIG. 21D is a schematic view of a fourth variation of the nip formation pad and surrounding components incorporated in the fixing device of FIG. 20.

Referring now to FIGS. 20 through 21D, a description is given of a fixing device 20Q as another variation of the fixing device 20 described above.

FIG. 20 is a schematic view of the fixing device 20Q.

Unlike the fixing device 20P, the fixing device 20Q does not include a fixing roller. The fixing device 20Q includes, e.g., a fixing belt 27, a pressure roller 31 and a secured nip formation pad 26. The fixing belt 27 is in contact with the pressure roller 31 via the nip formation pad 26, thereby forming a nip N between the fixing belt 27 and the pressure roller 31.

FIGS. 21A through 21D illustrate four variations of the nip formation pad 26. FIG. 21A is a schematic view of a nip formation pad 26A as a first variation of the nip formation pad 26 and surrounding components. FIG. 21B is a schematic view of a nip formation pad 26B as a second variation of the nip formation pad 26 and surrounding components. FIG. 21C is a schematic view of a nip formation pad 26C as a third variation of the nip formation pad 26 and surrounding components. FIG. 21D is a schematic view of a nip formation pad 26D as a fourth variation of the nip formation pad 26 and surrounding components.

The nip formation pads 26A through 26D differ in the shape of a surface thereof contacting the fixing belt 27. The shapes of the nip formation pads 26A through 26D respectively correspond to the fixing roller 21 of FIG. 10, the fixing roller 21S of FIG. 14, the fixing roller 21T of FIG. 17 and the fixing roller 21U of FIG. 18. In other words, the fixing device 20Q includes any one of the nip formation pads 26A through 26D. Due to the configuration of the nip formation pad 26, one of the fixing belt 27 and the pressure roller 31 has an outer diameter increasing while the other has an outer diameter decreasing in a curved line from an axial center portion to axial end portions of the fixing belt 27 and the pressure roller 31 at least at the nip N.

One approach to enhancing removal of toner from the rotary bodies of the fixing device involves incorporating a cleaner in the fixing device, such as a cleaning web or a cleaning roller that removes toner from the surface of, e.g., a pressure roller. However, providing such a cleaner increases production costs and enlarges the device. Additionally, the toner collected by the cleaner might congeal and cause noise, or a certain amount of toner might rest on the cleaner and consequently melt, resulting in contamination of the recording media.

Figure 22A:
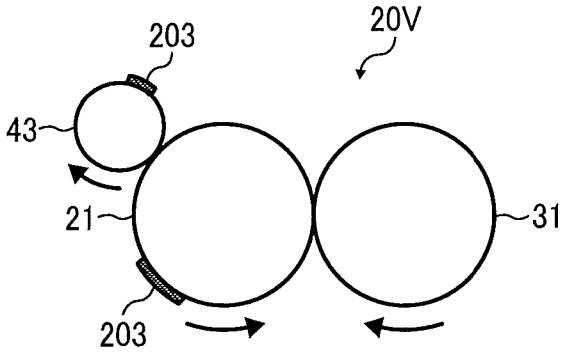
FIG. 22A is a schematic view of a fixing device incorporating a cleaner according to a fifth embodiment.
Figure 22B:
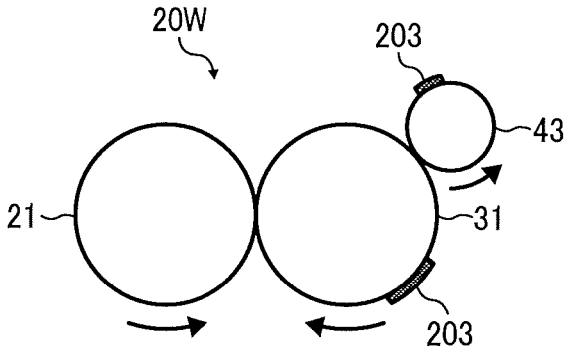
FIG. 22B is a schematic view of a fixing device incorporating a cleaner according to a sixth embodiment.

Referring now to FIGS. 22A and 22B, a description is given of fixing devices according to fifth and sixth embodiments, each of which incorporates a cleaner to reliably prevent toner from adhering the rollers of the fixing devices.

FIG. 22A is a schematic view of a fixing device 20V according to the fifth embodiment. FIG. 22B is a schematic view of a fixing device 20W according to the sixth embodiment.

As illustrated in FIG. 22A, the fixing device 20V includes a fixing roller 21, a pressure roller 31 and a cleaning roller 43 serving as a cleaner that contacts the surface of the fixing roller 21. As illustrated in FIG. 22B, the fixing device 20W includes a fixing roller 21, a pressure roller 31 and a cleaning roller 43 serving as a cleaner that contacts the surface of the pressure roller 31. In the fixing devices 20V and 20W, a recording medium P scrapes off toner 203 from the fixing roller 21 or the pressure roller 31 while passing through a nip between the fixing roller 21 and the pressure roller 31. Additionally, the cleaning roller 43 removes the toner 203 from the fixing roller 21 or the pressure roller 31. Thus, the removal of the toner 203 is enhanced, preventing appearance of faulty images.

Since the recording medium P removes the toner 203, the cleaning roller 43 removes and collects a decreased amount of the toner 203 from the fixing roller 21 or the pressure roller 31. Accordingly, such problems as described above are prevented.

As described above, in a fixing device according to an embodiment of this disclosure, a recording medium passes between rotary bodies, such as a fixing roller and a pressure roller, with a circumferential component of a shear force generated between the rotary bodies by use of a plain bearing, which supports one of the rotary bodies, being in a range of from 15N to 25N. Accordingly, a removal force for removing an extraneous matter is sufficiently generated between the recording medium and the rotary bodies. In short, the fixing device according to an embodiment of this disclosure generates a greater removal force than the comparative fixing device including a fixing rotary body and a pressure rotary body having different traveling velocities without a recording medium therebetween. Accordingly, the fixing device according to an embodiment of this disclosure reliably removes an extraneous matter such as toner adhering to the rotary bodies, and further, prevents the recording medium from being wrinkled. Thus, a reliable image is obtained with the fixing device.

Additionally, in the fixing device according to an embodiment of this disclosure, one of the rotary bodies has an outer diameter increasing in a curved line from an axial center portion to axial end portions of the rotary bodies while the other has an outer diameter decreasing in a curved line from an axial center portion to axial end portions of the rotary bodies to generate shear forces having different intensities axially along the rotary bodies. Accordingly, the extraneous matter is effectively removed from the rotary bodies with such different shear forces.

Further, in the fixing device according to an embodiment of this disclosure, the extraneous matter adhering to the rotary bodies is transferred to the recording medium and thus removed. Accordingly, the fixing device obviates the need for incorporating a cleaner such as a cleaning web and a cleaning roller, thereby reducing production costs and downsizing the device.

Optionally, as illustrated in FIGS. 22A and 22B, a cleaner may be provided to remove toner from the fixing roller or the pressure roller. Since the recording medium removes the toner, the cleaner removes and collects a decreased amount of toner from the rollers. Accordingly, problems are prevented that the toner collected by the cleaning roller congeals and causes noise, or that a certain amount of toner rests on the cleaning roller and consequently melts, resulting in contamination of the recording media.

Furthermore, in the fixing device according to an embodiment of this disclosure, the extraneous matter is effectively removed each time the recording medium passes between the rotary bodies. Accordingly, the fixing device according to an embodiment of this disclosure removes the extraneous matter more frequently than the comparative fixing device that does not remove toner while a recording medium is passing between the rotary bodies. As a result, the fixing device effectively minimizes accumulation of the extraneous matters on the rotary bodies.

These advantages of the embodiments of this disclosure are particularly prominent when using a recording medium containing a large amount of filler such as calcium carbonate, and when using toner containing silica particles including silicone oil as external additives. Such kind of toner is obtained by, e.g., adding two parts of hydrophobic silica RY50 (produced by Aerosil Co., Ltd.) including silicone oil on a surface or coated by silicone oil to a hundred part of ground toner or polymerization toner, conducting a mixing treatment for five minutes with a 20L HENSCHEL MIXER at a circumferential velocity of 40 m/sec., and screening the mixture with a sieve of 75-μm mesh.

This disclosure has been described above with reference to specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different embodiments may be combined with each other and/or substituted for each other within the scope of this invention. The number of constituent elements and their locations, shapes, and so forth are not limited to any of the structure for performing the methodology illustrated in the drawings. For example, the image forming apparatus incorporating the fixing device according to an embodiment described above is not limited to a color image forming apparatus as illustrated in FIG. 1, but may be a monochrome image forming apparatus. Additionally, the image forming apparatus to which the embodiments of this disclosure is applied includes but is not limited to a printer, a copier, a facsimile machine, or a multifunction peripheral having one or more capabilities of these devices.

What is claimed is:

1. A fixing device comprising:

a first rotary body;

a second rotary body to contact the first rotary body to form an area of contact between the first rotary body and the second rotary body, through which a recording medium bearing a toner image passes; and a plain bearing that supports the first rotary body or the second rotary body, one rotary body of the first rotary body and the second rotary body having an outer diameter increasing in a curved line from an axial center portion to axial end portions of the one rotary body at least at the area of contact between the first rotary body and the second rotary body, the other rotary body of the first rotary body and the second rotary body having an outer diameter decreasing in a curved line from an axial center portion to axial end portions of the other rotary body at least at the area of contact between the first rotary body and the second rotary body, wherein the recording medium passes between the first rotary body and the second rotary body with a circumferential component of a shear force generated between the first rotary body and the second rotary body by use of the plain bearing being in a range of from 15N to 25N.

2. The fixing device according to claim 1, wherein the first rotary body is a hard roller, and the second rotary body is an elastic roller softer than the hard roller to contact the hard roller to be elastically deformed, and wherein the first rotary body has an outer diameter increasing in a curved line from the axial center portion to the axial end portions of the first rotary body.

3. The fixing device according to claim 2, wherein a rate of increase in the outer diameter of the first rotary body increases from the axial center portion to the axial end portions of the first rotary body.

4. The fixing device according to claim 2, wherein a rate of increase in the outer diameter of the first rotary body decreases from the axial center portion to the axial end portions of the first rotary body.

5. The fixing device according to claim 1, wherein the shear force generated between the first rotary body and the second rotary body inclines toward the axial end portions of the first rotary body and the second rotary body with respect to a recording medium conveyance direction perpendicular to a line connecting an axis of rotation of the first rotary body and an axis of rotation of the second rotary body.

6. The fixing device according to claim 1, wherein the shear force generated between the first rotary body and the second rotary body increases from the axial center portion to the axial end portions of the first rotary body and the second rotary body.

7. The fixing device according to claim 1, wherein the shear force generated between the first rotary body and the second rotary body decreases from the axial center portion to the axial end portions of the first rotary body and the second rotary body.

8. The fixing device according to claim 1, wherein the circumferential component of the shear force generated between the first rotary body and the second rotary body equals a total torque generated on one rotary body of the first rotary body and the second rotary body divided by an average radius of the one rotary body.

9. The fixing device according to claim 1, wherein the first rotary body is a driving rotary body to rotate with a driving force applied, and the second rotary body is a driven rotary body to rotate in conjunction with the first rotary body.

10. An image forming apparatus comprising:

an image forming device to form a toner image; and a fixing device disposed downstream from the image forming device in a recording medium conveyance direction, the fixing device including:

a first rotary body;

a second rotary body to contact the first rotary body to form an area of contact between the first rotary body and the second rotary body, through which a recording medium bearing a toner image passes; and a plain bearing that supports the first rotary body or the second rotary body, one rotary body of the first rotary body and the second rotary body having an outer diameter increasing in a curved line from an axial center portion to axial end portions of the one rotary body at least at the area of contact between the first rotary body and the second rotary body, the other rotary body of the first rotary body and the second rotary body having an outer diameter decreasing in a curved line from an axial center portion to axial end portions of the other rotary body at least at the area of contact between the first rotary body and the second rotary body, wherein the recording medium passes between the first rotary body and the second rotary body with a circumferential component of a shear force generated between the first rotary body and the second rotary body by use of the plain bearing being in a range of from 15N to 25N.

* * * * *